US009535397B2

(12) United States Patent
Kondo

(10) Patent No.: US 9,535,397 B2
(45) Date of Patent: Jan. 3, 2017

(54) IMAGE FORMING APPARATUS

(71) Applicant: FUJI XEROX CO., LTD., Tokyo (JP)

(72) Inventor: Takayuki Kondo, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/692,148

(22) Filed: Apr. 21, 2015

(65) Prior Publication Data

US 2016/0026148 A1 Jan. 28, 2016

(30) Foreign Application Priority Data

Jul. 25, 2014 (JP) ..... 2014-152310

(51) Int. Cl.
*G03G 21/18* (2006.01)
*G03G 21/16* (2006.01)

(52) U.S. Cl.
CPC ..... *G03G 21/185* (2013.01); *G03G 21/168* (2013.01); *G03G 21/1671* (2013.01); *G03G 21/1633* (2013.01); *G03G 21/1647* (2013.01); *G03G 2215/0132* (2013.01); *G03G 2221/1684* (2013.01); *G03G 2221/1869* (2013.01)

(58) Field of Classification Search
CPC ..... G03G 21/1623; G03G 21/1671; G03G 21/1676; G03G 21/168; G03G 21/1842; G03G 21/185; G03G 2221/1684; G03G 2221/1869
See application file for complete search history.

(56) References Cited

U.S. PATENT DOCUMENTS

| | | | | |
|---|---|---|---|---|
| 7,031,638 | B2 * | 4/2006 | Tanizaki | G03G 21/1638 399/112 |
| 8,280,279 | B2 * | 10/2012 | Mizuno | G03G 21/1842 399/107 |
| 8,768,206 | B2 | 7/2014 | Sato | |
| 8,892,002 | B2 | 11/2014 | Sato | |
| 2001/0009621 | A1 * | 7/2001 | Nakazato | G03G 21/1839 399/111 |
| 2003/0053819 | A1 * | 3/2003 | Nomura | G03G 15/0896 399/110 |

(Continued)

FOREIGN PATENT DOCUMENTS

| | | |
|---|---|---|
| JP | 2011-065030 A | 3/2011 |
| JP | 2012-150522 A | 8/2012 |

(Continued)

*Primary Examiner* — David Gray
*Assistant Examiner* — Carla Therrien
(74) *Attorney, Agent, or Firm* — Sughrue Mion, PLLC

(57) ABSTRACT

An image forming apparatus includes a support body provided in an apparatus body to be drawn out from the apparatus body while supporting a supported body, and having a support portion on a front side of the supported body in a drawing direction, and an image forming body on which an image to be transferred on the supported body or a recording medium transported by the support body is formed, the image forming body being provided in the apparatus body to be drawn out from the apparatus body in the drawing direction of the support body and being positioned relative to the apparatus body in an intersecting direction intersecting the drawing direction with an end portion on a front side in the drawing direction abutting on the support portion in the intersecting direction.

4 Claims, 10 Drawing Sheets

(56) References Cited

U.S. PATENT DOCUMENTS

| | | | | |
|---|---|---|---|---|
| 2005/0220481 | A1* | 10/2005 | Yamaguchi | G03G 21/185 399/111 |
| 2008/0138105 | A1* | 6/2008 | Kanno | G03G 21/185 399/111 |
| 2008/0138106 | A1* | 6/2008 | Kanno | G03G 21/185 399/111 |
| 2009/0028601 | A1* | 1/2009 | Mizuno | G03G 21/185 399/111 |
| 2009/0290903 | A1* | 11/2009 | Horikawa | G03G 21/185 399/111 |
| 2009/0297216 | A1* | 12/2009 | Kawai | G03G 21/1825 399/111 |
| 2011/0299885 | A1* | 12/2011 | Taba | G03G 21/185 399/111 |
| 2012/0243902 | A1* | 9/2012 | Ohba | G03G 21/185 399/110 |
| 2014/0072332 | A1* | 3/2014 | Kitamura | G03G 21/1633 399/107 |

FOREIGN PATENT DOCUMENTS

| | | | |
|---|---|---|---|
| JP | 2013-007947 | A | 1/2013 |
| JP | 2013-007948 | A | 1/2013 |

* cited by examiner

IMAGE FORMING APPARATUS

CROSS-REFERENCE TO RELATED APPLICATIONS

This application is based on and claims priority under 35 USC 119 from Japanese Patent Application No. 2014-152310 filed Jul. 25, 2014.

BACKGROUND

Technical Field

The present invention relates to an image forming apparatus.

SUMMARY

According to an aspect of the invention, there is provided an image forming apparatus including a support body provided in an apparatus body to be drawn out from the apparatus body while supporting a supported body, and having a support portion on a front side of the supported body in a drawing direction, and an image forming body on which an image to be transferred on the supported body or a recording medium transported by the support body is formed, the image forming body being provided in the apparatus body to be drawn out from the apparatus body in the drawing direction of the support body and being positioned relative to the apparatus body in an intersecting direction intersecting the drawing direction with an end portion on a front side in the drawing direction abutting on the support portion in the intersecting direction.

BRIEF DESCRIPTION OF THE DRAWINGS

An exemplary embodiment of the present invention will be described in detail based on the following figures, wherein.

DETAILED DESCRIPTION

An exemplary embodiment of the present invention will be described below with reference to the drawings.

Configuration of Image Forming Apparatus 10

Figure 1:
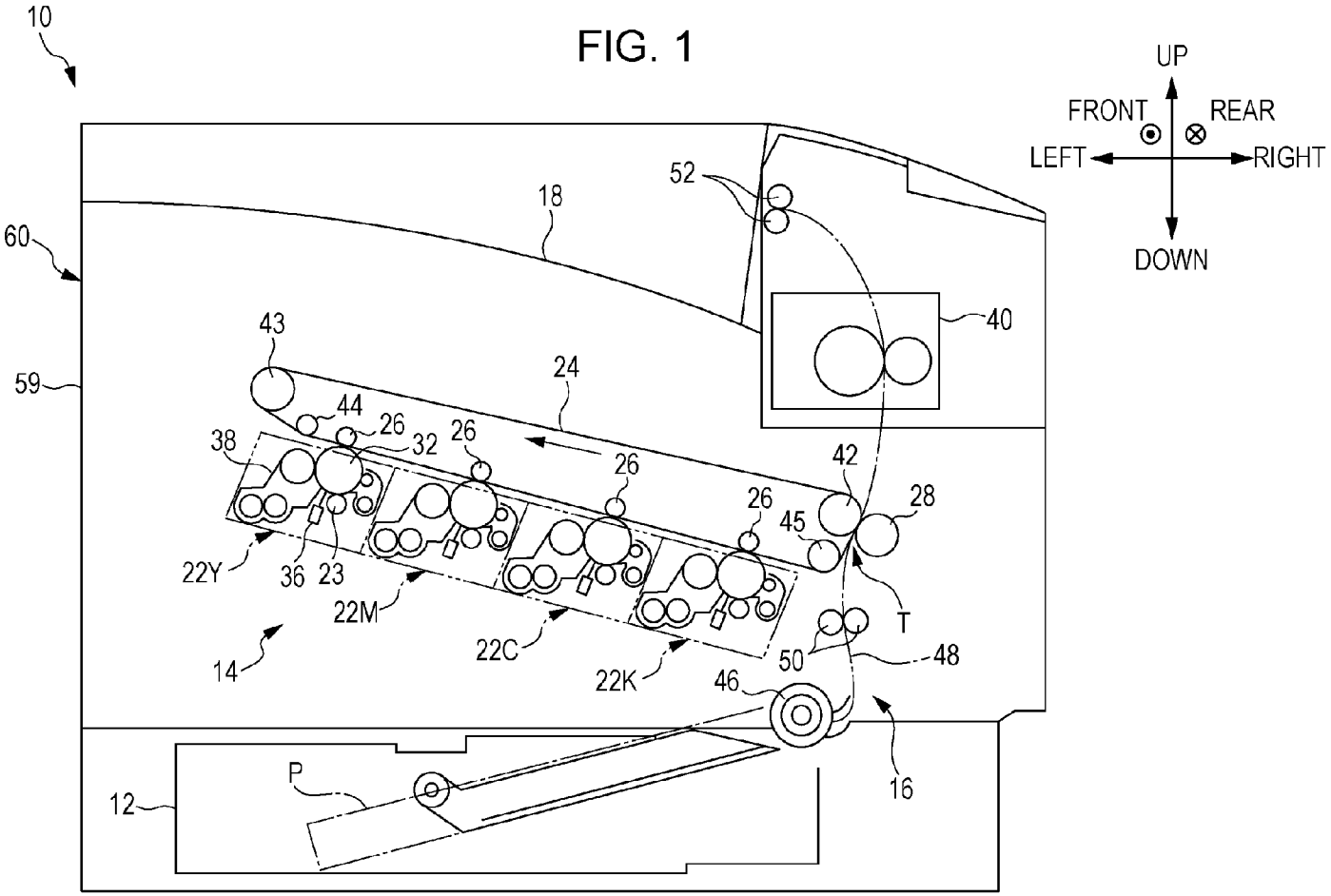
FIG. 1 is a schematic view illustrating the configuration of an image forming apparatus according to an exemplary embodiment.

First, the configuration of an image forming apparatus 10 according to the exemplary embodiment will be described. FIG. 1 is a schematic view illustrating the configuration of the image forming apparatus 10. Front, rear, right, left, up and down used in the following description correspond to directions of arrows in the drawings. These directions are determined for convenience of explanation, and the front-rear direction and the right-left direction of the apparatus are not limited to the directions of the arrows in the drawings. In each of the drawings, an encircled cross represents an arrow directed from the front side to the depth side of the paper of the drawing, and an encircled dot represents an arrow directed from the depth side to the front side of the paper of the drawing.

As illustrated in FIG. 1, the image forming apparatus 10 includes an image forming apparatus body 60 that accommodates constituent components. Within the image forming apparatus body 60, there are provided a storage section 12 that stores recording media P such as paper, an image forming section 14 that forms images on the recording media P, and a transport section 16 that transports the recording media P from the storage section 12 to the image forming section 14. In an upper part of the image forming apparatus body 60, there is provided an output section 18 into which the recording media P are output after the images are formed thereon by the image forming section 14.

The image forming section 14 includes image forming units 22Y, 22M, 22C, and 22K (hereinafter referred to as image forming units 22Y to 22K), serving as an example of an image forming body, which form toner images of yellow (Y), magenta (M), cyan (C), and black (K) colors, respectively, and an intermediate transfer belt 24 (transfer body) on which the toner images formed by the image forming units 22Y to 22K are to be transferred. The image forming section 14 further includes first transfer rollers 26 that transfer the toner images formed by the image forming units 22Y to 22K onto the intermediate transfer belt 24, and a second transfer roller 28 that transfers the toner images, which are transferred on the intermediate transfer belt 24 by the first transfer rollers 26, from the intermediate transfer belt 24 onto a recording medium P at a transfer position T.

The intermediate transfer belt 24 has an annular shape, and is disposed on an upper side of the image forming units 22Y to 22K. On an inner peripheral side of the intermediate transfer belt 24, winding rollers 42, 43, 44, and 45 on which the intermediate transfer belt 24 is wound are provided. The winding roller 42 serves as an opposed roller provided opposed to the second transfer roller 28. The winding roller 43 serves as a driving roller. The winding roller 44 serves as a tension roller that applies tension to the intermediate transfer belt 24. When the winding roller 43 rotates, the intermediate transfer belt 24 circularly moves (rotates) in one direction (for example, a counterclockwise direction in FIG. 1) while being in contact with photoconductors 32. The intermediate transfer belt 24 forms a part of a transfer unit 70 (to be described later).

The transport section 16 includes a feed out roller 46 that feeds out a recording medium P stored in the storage section 12, a transport path 48 through which the recording medium P fed out by the feed out roller 46 is transported, and transport rollers 50 that transport the recording medium P fed by the feed out roller 46 to the transfer position T.

On a downstream side of the transfer position T in the transport direction, a fixing device 40 is provided to fix toner images transferred on the recording medium P by the second transfer roller 28 onto the recording medium P. On a downstream side of the fixing device 40 in the transport direction, output rollers 52 are provided to output the recording medium P into the output section 18 after the toner images are fixed on the recording medium P.

Image Forming Units 22Y to 22K

The image forming units 22Y to 22K are provided in the image forming apparatus body 60 to be drawn out frontward from the image forming apparatus body 60. Specifically, as illustrated in FIG. 1, the image forming units 22Y to 22K include their respective photoconductors 32 that rotate in one direction (for example, a clockwise direction in FIG. 1).

Figure 2:
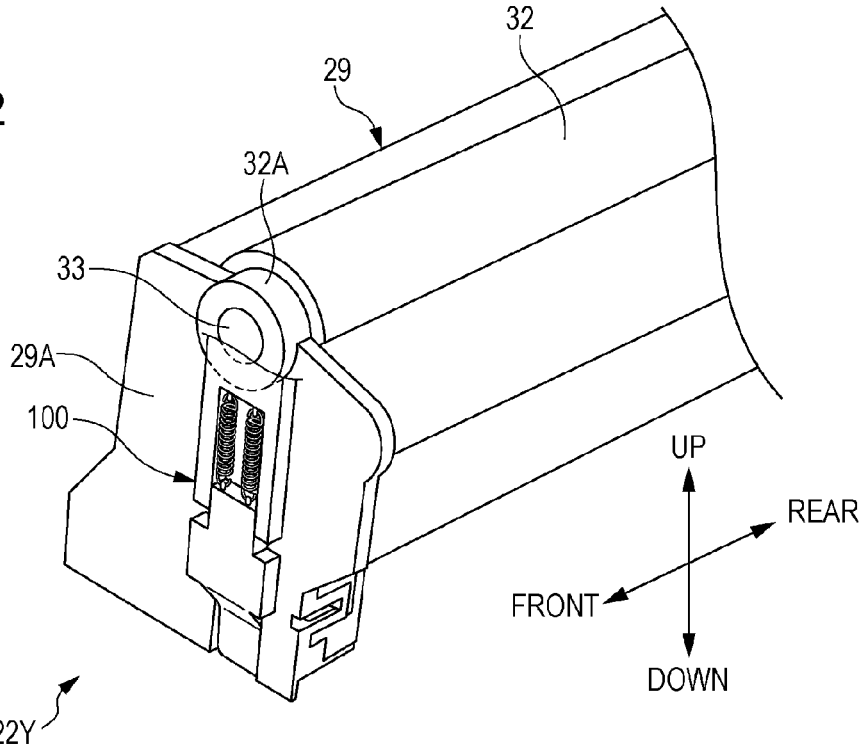
FIG. 2 is a perspective view illustrating a front end structure of an image forming unit in the exemplary embodiment.
Figure 3:
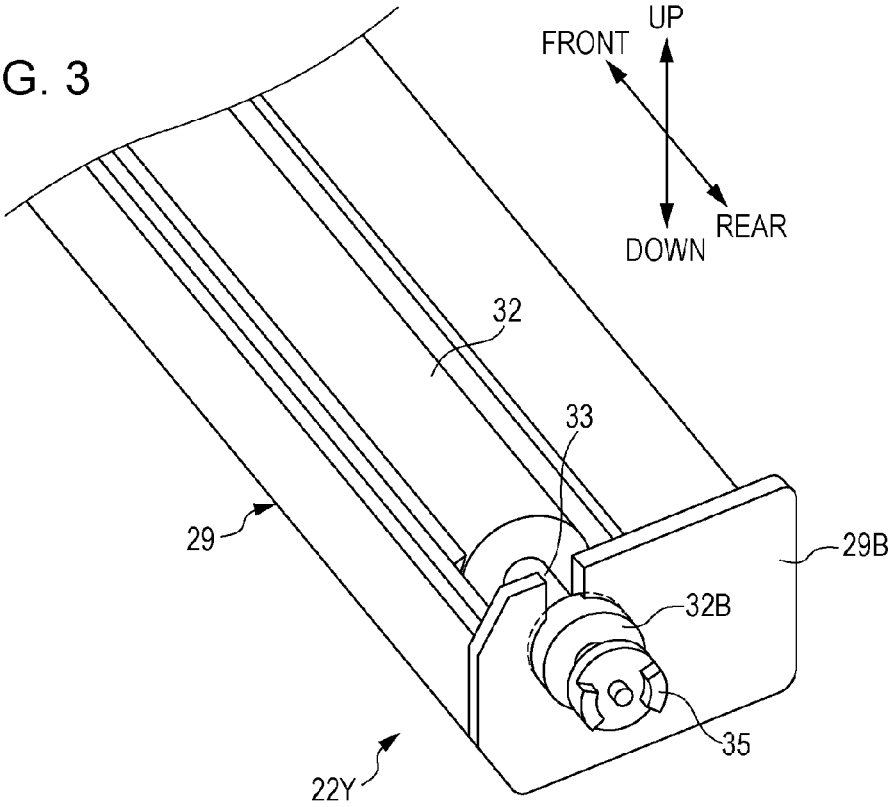
FIG. 3 is a perspective view illustrating a rear end structure of the image forming unit in the exemplary embodiment.

Specifically, as illustrated in FIGS. 2 and 3, both ends of a rotation shaft 33 of each photoconductor 32 are rotatably supported by bearing portions 32A and 32B, and the photoconductor 32 is rotated by driving force transmitted via a gear 35. Since the image forming units 22Y to 22K are similarly configurated, the reference numerals of the components of the image forming units 22M, 22C, and 22K are omitted in FIG. 1.

As illustrated in FIG. 1, around each photoconductor 32, a charging roller 23, an exposure device 36, and a developing device 38 are arranged in order from the upstream side in the rotating direction of the photoconductor 32. The charging roller 23 serves as a charging device that charges the photoconductor 32. The exposure device 36 forms an electrostatic latent image on the photoconductor 32 by exposing the photoconductor 32 charged by the charging roller 23. The developing device 38 forms a toner image by developing the electrostatic latent image formed on the photoconductor 32 by the exposure device 36.

Each of the image forming units 22Y to 22K includes a housing 29 having a front plate 29A (see FIG. 2) and a rear plate 29B (see FIG. 3). An upper part of the housing 29 is open, and a part of the outer periphery of the photoconductor 32 and a part of the outer periphery of the bearing portion 32A are exposed upward, as illustrated in FIG. 2. The bearing portion 32A protrudes frontward from the front plate 29A. The front plate 29A is provided with an abutting member 100 (to be described later). Further, as illustrated in FIG. 3, the bearing portion 32B protrudes rearward from the rear plate 29B.

It is only necessary that the image forming units 22Y to 22K to be drawn out from the image forming apparatus body 60 should each include at least the photoconductor 32.

Transfer Unit 70

Figure 4:
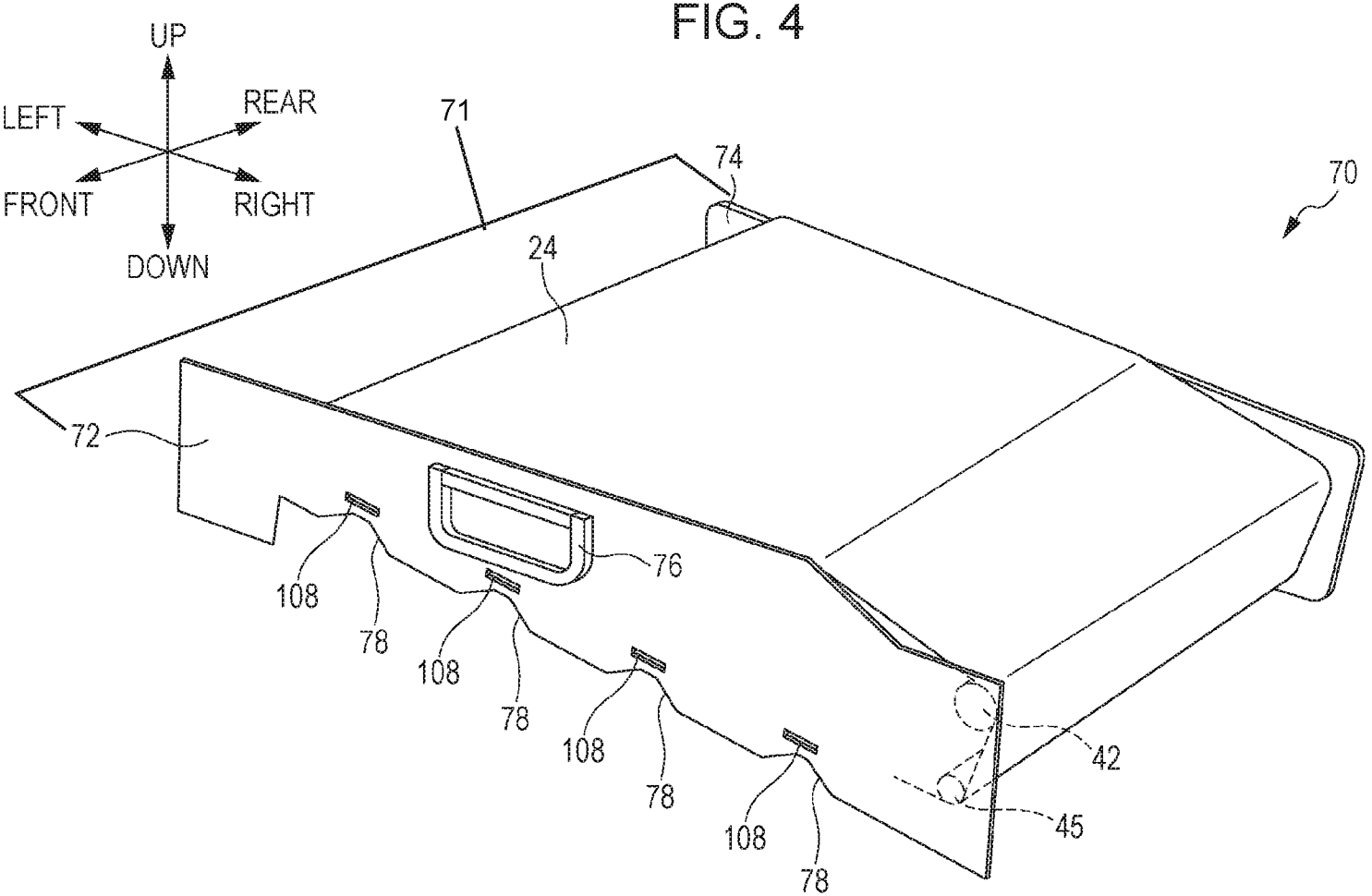
FIG. 4 is a perspective view illustrating the structure of a transfer unit in the exemplary embodiment.

The transfer unit 70 is provided in the image forming apparatus body 60 to be drawn out frontward from the image forming apparatus body 60, similarly to the image forming units 22Y to 22K. Specifically, as illustrated in FIG. 4, the transfer unit 70 includes the intermediate transfer belt 24 serving as an example of a supported body, and a support body 71 that supports the intermediate transfer belt 24. The support body 71 includes a front plate 72 serving as an example of a support portion, a rear plate 74, and the above-described winding rollers 42, 43, 44, and 45.

The front plate 72 is formed by a frame (plate) disposed on the front side (front side in the drawing direction) of the intermediate transfer belt 24. The rear plate 74 is formed by a frame (plate) disposed on the rear side (depth side in the drawing direction) of the intermediate transfer belt 24. Specifically, the front plate 72 and the rear plate 74 support the intermediate transfer belt 24 by rotatably supporting both axial ends of each of the winding rollers 42, 43, 44, and 45 on which the intermediate transfer belt 24 is wound.

On a front surface of the front plate 72, a handle 76 is provided as a grip portion to be gripped when drawing out the transfer unit 70 frontward from the image forming apparatus body 60. The support body 71 is drawn out frontward from the image forming apparatus body 60 together with the intermediate transfer belt 24 while supporting the intermediate transfer belt 24.

Image Forming Apparatus Body 60

Figure 5:
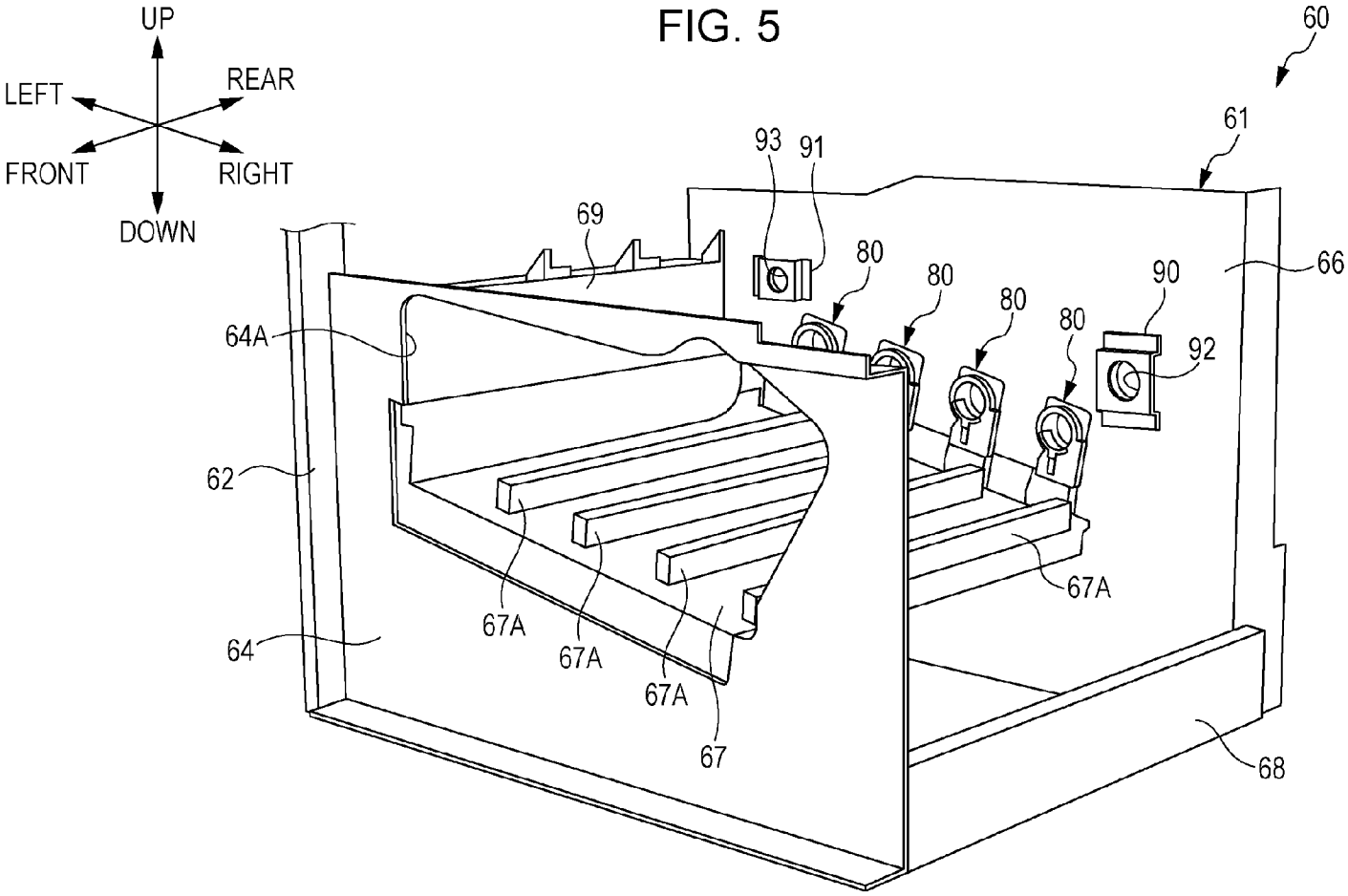
FIG. 5 is a perspective view illustrating the structure of an image forming apparatus body in the exemplary embodiment.

Next, a specific structure of the image forming apparatus body 60 will be described. FIG. 5 is a perspective view illustrating the specific structure of the image forming apparatus body 60.

As illustrated in FIG. 5, the image forming apparatus body 60 includes a frame 61 and a housing 59 (exterior cover, see FIG. 1). The frame 61 includes a support column 62, a front frame 64 (front wall), a rear frame 66 (rear wall), a right frame 68 (right side wall), a left frame 69 (left side wall), and a connecting frame 67 (connecting wall).

The support column 62 forms a left front part of the image forming apparatus body 60. A left end portion of the front frame 64 is fixed to the support column 62. The left frame 69 connects an upper part of the left end portion of the front frame 64 to an upper part of a left end portion of the rear frame 66. The right frame 68 connects a lower part of a right end portion of the front frame 64 and a lower part of a right end portion of the rear frame 66.

Figure 6:
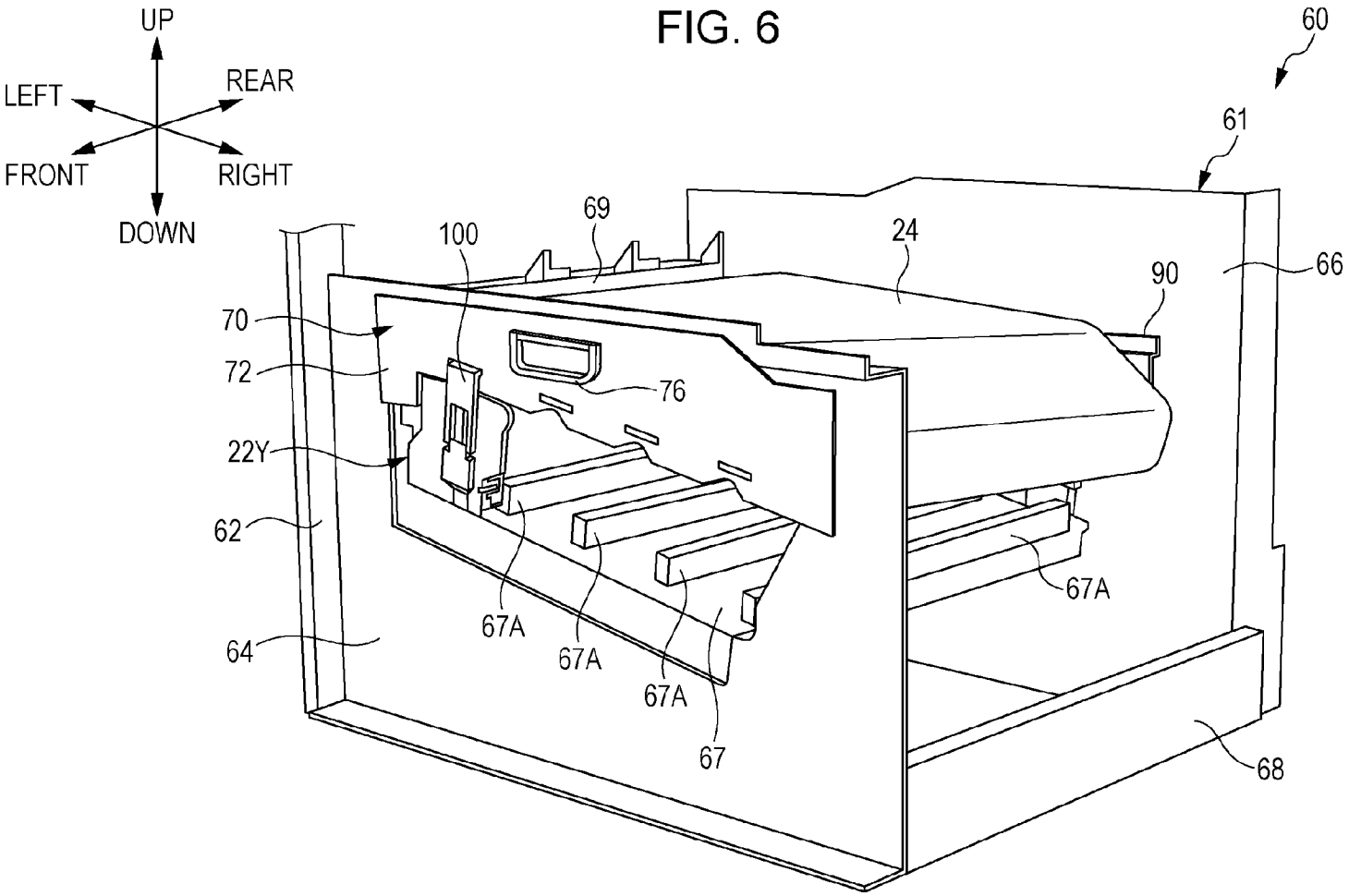
FIG. 6 is a perspective view illustrating a state in which the transfer unit and the image forming unit are stored in the image forming apparatus body illustrated in FIG. 5.

The front frame 64 has an opening 64A from which the image forming units 22Y to 22K and the transfer unit 70 are to be drawn out frontward from a housed position (position illustrated in FIG. 6). To a lower edge of the opening 64A, a front end portion of the connecting frame 67 is fixed. A rear end portion of the connecting frame 67 is fixed to the rear frame 66. Thus, the connecting frame 67 connects the front frame 64 and the rear frame 66.

The connecting frame 67 is provided with guide members 67A (guides) that guide the image forming units 22Y to 22K in a loading and unloading direction (drawing direction and inserting direction). The guide members 67A extend on the connecting frame 67 in the front-rear direction. Further, an unillustrated guide member (guide) is provided between the front frame 64 and the rear frame 66 to guide the transfer unit 70 in the loading and unloading direction.

The unillustrated guide member and the guide members 67A allow the image forming units 22Y to 22K and the transfer unit 70 to move in the front-rear direction between the housed position (position illustrated in FIG. 6) where the units are housed (loaded) in the image forming apparatus body 60 and a withdrawn position where the units are drawn out frontward from the housed position. In FIG. 6, only the image forming unit 22Y, of the image forming units 22Y to 22K, is illustrated.

At the housed position (housed state) of the transfer unit 70, the intermediate transfer belt 24 and the rear plate 74 are located between the front frame 64 and the rear frame 66. At the withdrawn position (withdrawn state) of the transfer unit 70, the intermediate transfer belt 24 is located in front of the front frame 64.

At the housed position (housed state) of the image forming units 22Y to 22K, the photoconductors 32 are located between the front frame 64 and the rear frame 66. At the withdrawn position (withdrawn state) of the image forming units 22Y to 22K, the photoconductors 32 are located in front of the front frame 64.

In the exemplary embodiment, the image forming units 22Y to 22K and the transfer unit 70 can be drawn out frontward together from the housed position to the withdrawn position. The image forming units 22Y to 22K and the transfer unit 70 may be drawn out independently. In this structure, when the image forming units 22Y to 22K and the transfer unit 70 are independently drawn out, the intermediate transfer belt 24 is retreated from the photoconductors 32, and abutting members 100 (to be described later) are removed from the front plate 72 of the transfer unit 70.

In this way, the transfer unit 70 and the image forming units 22Y to 22K are loaded and unloaded in the same direction. The image forming units 22Y to 22K can be inserted and drawn out in the loading and unloading direction of the transfer unit 70.

The transfer unit 70 and the image forming units 22Y to 22K can be exchanged after being drawn out from the image forming apparatus body 60 and removed from the image forming apparatus body 60. The transfer unit 70 and the image forming units 22Y to 22K may be configurated so that they are drawn out from the image forming apparatus body 60, but are not removed from the image forming apparatus body 60.

The image forming apparatus body 60 further includes an exterior cover (not illustrated) in front of the front plate 72 of the transfer unit 70 at the housed position and the front plate 29A of each of the image forming units 22Y to 22K at the housed position. Therefore, the transfer unit 70 and the image forming units 22Y to 22K are drawn out after the exterior cover is opened.

Positioning of Transfer Unit 70

Next, a description will be given of a structure for positioning the transfer unit 70 relative to the image forming apparatus body 60.

As illustrated in FIG. 5, the rear frame 66 is provided with positioning members 90 and 91 that position the rear end portion of the transfer unit 70. The positioning members 90 and 91 respectively have insertion holes 92 and 93 in which bearing portions (not illustrated) of the winding rollers 42 and 43 of the transfer unit 70 in a state housed in the image forming apparatus body 60 are to be inserted. When the bearing portions are inserted in the insertion holes 92 and 93, the rear end portion of the transfer unit 70 is positioned relative to the rear frame 66 in the up-down direction and the right-left direction.

On a rear surface of the front plate 72, contact portions (not illustrated) are provided to be in contact with an upper edge 63 and a side edge 65 of the opening 64A of the front frame 64. In the housed state of the transfer unit 70, the contact portions are in contact with the upper edge 63 and the side edge 65 of the opening 64A, so that the front end portion of the transfer unit 70 is positioned relative to the front frame 64 in the up-down direction and the right-left direction.

Further, the rear surface of the front plate 72 is in contact with the front surface of the front frame 64, so that the transfer unit 70 is positioned relative to the front frame 64 in the front-rear direction.

As described above, in the housed state (housed position) in the image forming apparatus body 60, the transfer unit 70 is positioned relative to the image forming apparatus body 60 (frame 61) serving as a positioning reference. The structure for positioning the transfer unit 70 relative to the image forming apparatus body 60 is not limited to the above-described structure.

Positioning of Image Forming Units 22Y to 22K

Next, a description will be given of a structure for positioning the image forming units 22Y to 22K relative to the image forming apparatus body 60.

Figure 7:
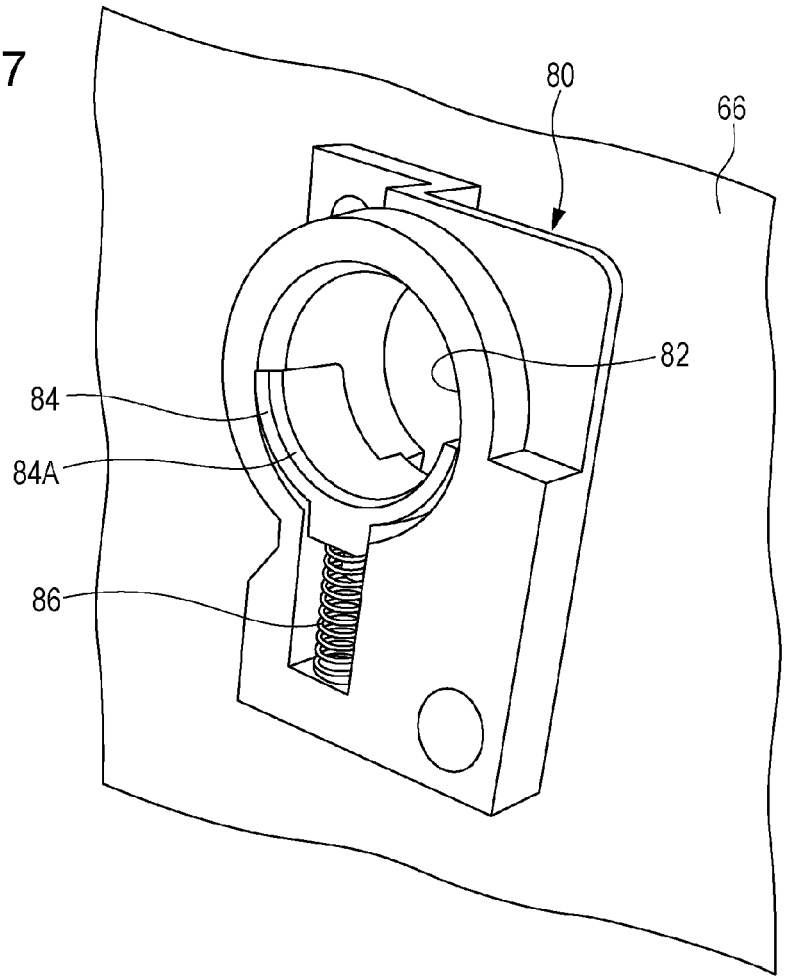
FIG. 7 is a perspective view illustrating the structure of a positioning member in the exemplary embodiment.

As illustrated in FIG. 5, the rear frame 66 is provided with positioning members 80 that position the rear end portions of the image forming units 22Y to 22K. As illustrated in FIG. 7, the positioning members 80 have their respective insertion holes 82. In the insertion holes 82, bearing portions 32B (see FIG. 3), serving as an example of a projection, which are provided in the rear end portions (depth side end portions in the drawing direction) of the image forming units 22Y to 22K in the housed state are inserted rearward (in a direction opposite from the drawing direction).

Below each insertion hole 82, a C-shaped (arc-shaped) pressing member 84 is provided to press the corresponding bearing portion 32B in the insertion hole 82 toward an upper edge of the insertion hole 82. The pressing member 84 is movable up and down within a range such that the insertion hole 82 maintains a space where the bearing portion 32B can be inserted, and is biased upward by a compression spring 86. The bearing portion 32B pushes down the pressing member 84 via a tapered portion 84A and is inserted in the insertion hole 82. The bearing portion 32B inserted in the insertion hole 82 is pressed upward by the pressing member 84, and the rear end portion of the corresponding one of the image forming units 22Y to 22K is positioned relative to the rear frame 66 in the up-down direction and the right-left direction serving as intersecting directions intersecting the drawing direction.

Figure 8:
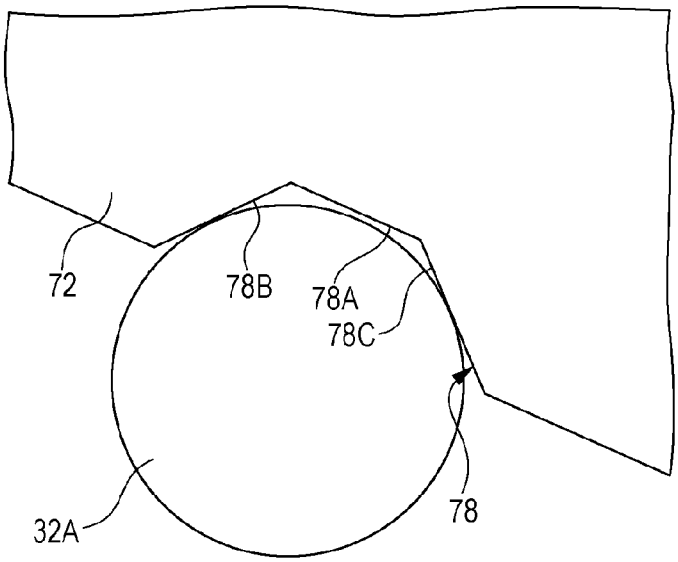
FIG. 8 illustrates a state in which a bearing portion abuts on a positioning groove in the exemplary embodiment.

In contrast, the front end portions of the image forming units 22Y to 22K are positioned relative to the image forming apparatus body 60, as will be described below. As illustrated in FIG. 4, on a lower end face of the front plate 72 of the transfer unit 70, four positioning grooves 78 are provided to position the front end portions of the image forming units 22Y to 22K. The positioning grooves 78 have an inverse V-shape (chevron shape) or a substantially inverse V-shape opening downward. Specifically, as illustrated in FIG. 8, each of the positioning grooves 78 includes inclined portions 78B and 78C and a top portion 78A. The inclined portions 78B and 78C and the top portion 78A are each formed by a flat face. The inclined portions 78B and 78C are inclined so as to gradually approach each other as they extend toward the upper side (toward the top portion 78A).

Figure 9:
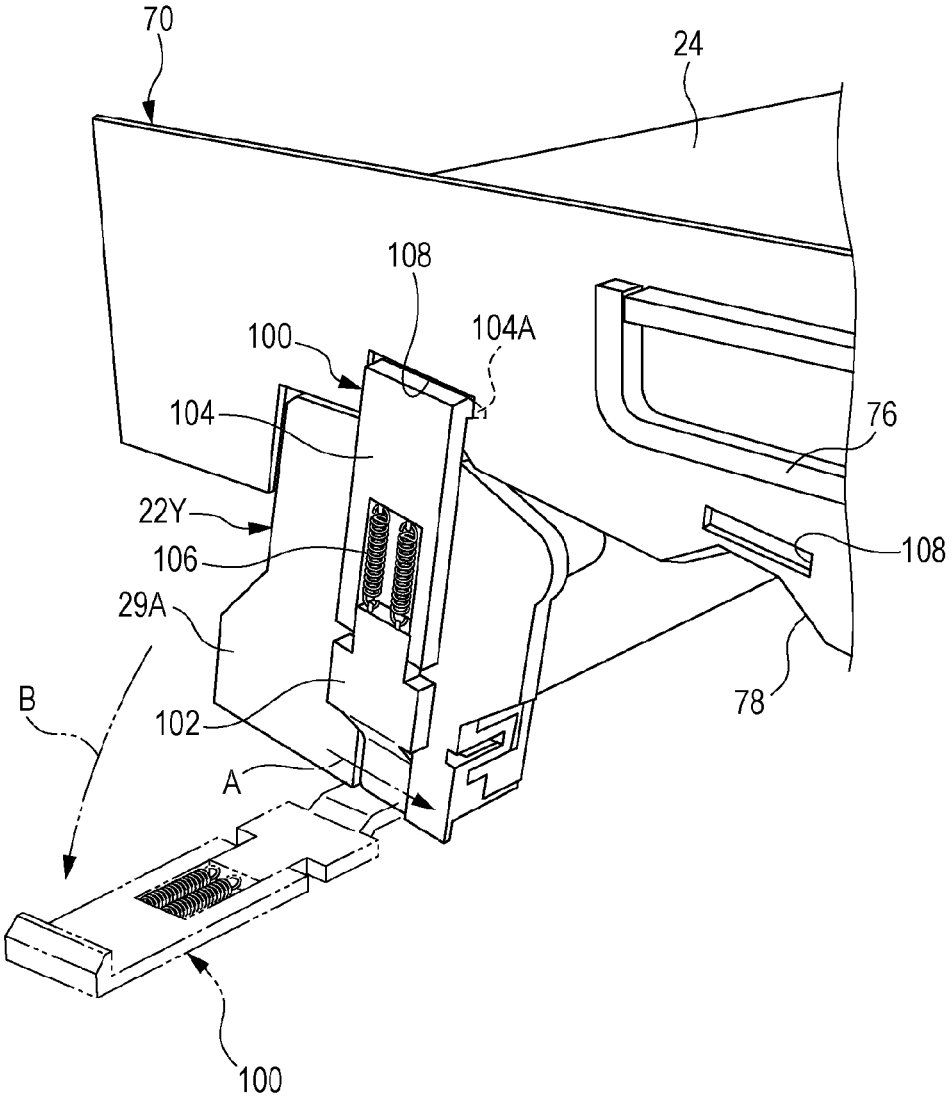
FIG. 9 is a perspective view illustrating the structure of an abutting member in the exemplary embodiment.
Figure 10:
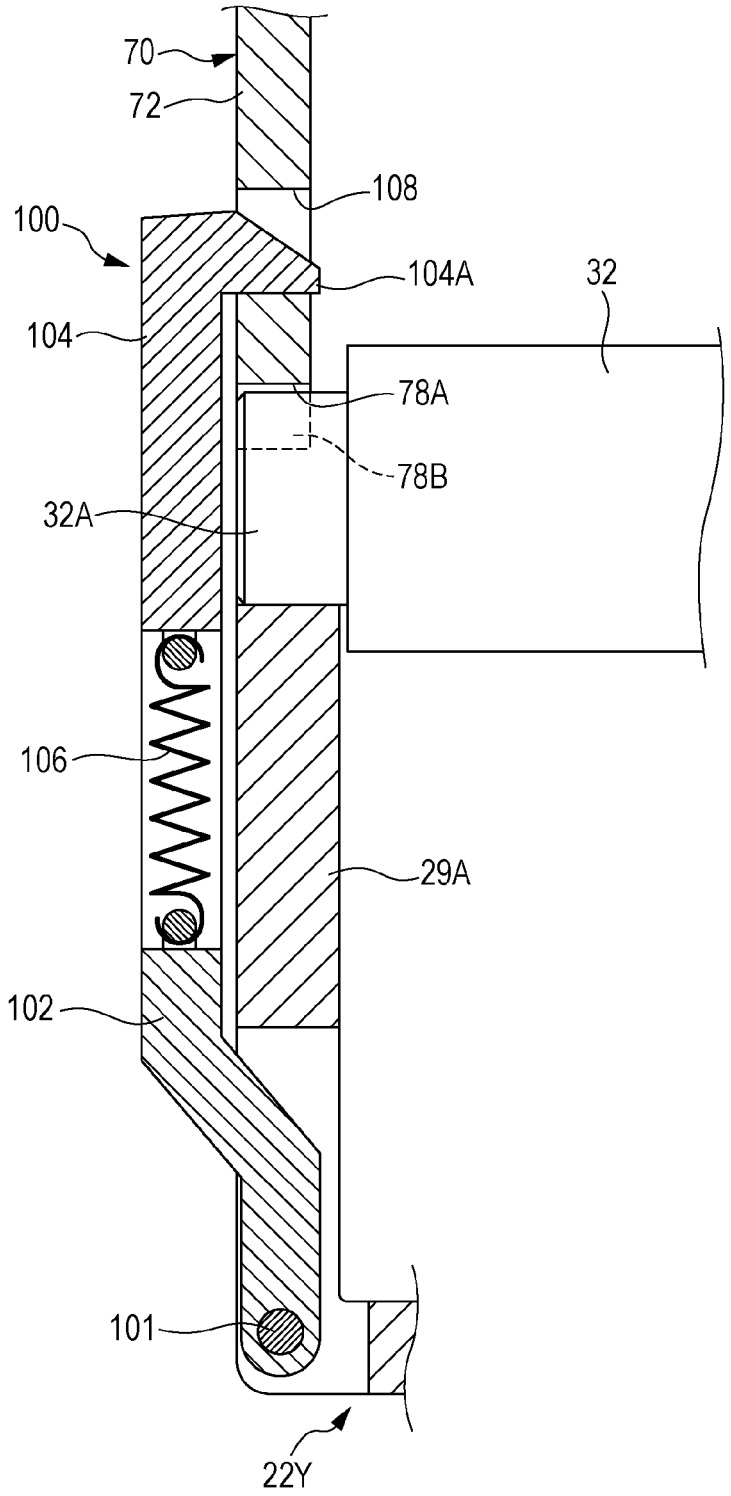
FIG. 10 is a sectional side view illustrating the structure of the abutting member in the exemplary embodiment.

As illustrated in FIGS. 9 and 10, each of the image forming units 22Y to 22K is provided with an abutting member 100 that contacts the bearing portion 32A with the corresponding positioning groove 78 by a force for pulling the front end portion of each of the image forming units 22Y to 22K toward the front plate 72.

As illustrated in FIG. 9, the abutting member 100 includes a body 102 supported by the corresponding image forming unit 22Y, 22M, 22C, or 22K to be rotatable on a turn shaft 101 (see FIG. 10) extending in a direction of arrow A, a hook 104 provided on a side of the body 102 opposite from the turn shaft 101, and tension springs 106 that pull the body 102 toward the hook 104.

A distal end portion 104A of the hook 104 is caught in a catching hole 108 of the front plate 72 in the transfer unit 70, and the corresponding image forming unit 22Y, 22M, 22C, or 22K is thereby pulled toward the transfer unit 70. Thus, the bearing portion 32A (see FIG. 2) provided as an example of a projection in the front end portion (front-side end portion in the drawing direction) of the image forming unit 22Y, 22M, 22C, or 22K abuts on the corresponding positioning groove 78 in the upward direction intersecting the drawing direction. As illustrated in FIG. 8, the bearing portion 32A is circular or substantially circular when viewed from the front side (front side in the drawing direction), and abuts at two points on the inclined portions 78B and 78C of the positioning groove 78. In a state in which the distal end portion 104A of the hook 104 is caught in the catching hole 108 of the front plate 72 in the transfer unit 70, the bearing portion 32A is kept abutting on the inclined portions 78B and 78C of the positioning groove 78.

When the bearing portion 32A thus abuts on the inclined portions 78B and 78C of the positioning groove 78, the front end portion of the image forming unit 22Y, 22M, 22C, or 22K is positioned relative to the transfer unit 70 in the up-down direction and the right-left direction serving as the intersecting directions intersecting the drawing direction. That is, the front end portion of the image forming unit 22Y, 22M, 22C, or 22K is positioned relative to the transfer unit 70 that is positioned relative to the image forming apparatus body 60.

Further, when the distal end portion 104A of the hook 104 is caught in the catching hole 108 of the front plate 72 in the transfer unit 70, the image forming unit 22Y, 22M, 22C, or 22K is positioned relative to the image forming apparatus body 60 via the transfer unit 70 in the front-rear direction.

As described above, the image forming units 22Y to 22K are positioned relative to the image forming apparatus body 60 (frame 61) serving as the positioning reference.

The abutting member 100 is removed from the transfer unit 70 by being turned on the turn shaft 101 (see FIG. 10) in a direction of arrow B, as shown by a two-dot chain line in FIG. 9. Alternatively, the abutting member 100 may be turnably provided in the transfer unit 70, and the hook 104 may be caught in the corresponding image forming unit 22Y, 22M, 22C, or 22K. That is, it is only necessary that the abutting member 100 should be disposed to extend from the image forming unit 22Y, 22M, 22C, or 22K to the transfer unit 70.

Operation of Exemplary Embodiment

Next, the operation of the exemplary embodiment will be described.

According to the exemplary embodiment, as described above, the transfer unit 70 and the image forming units 22Y to 22K are loaded and unloaded in the same direction, and the image forming units 22Y to 22K can be inserted and withdrawn in the loading and unloading direction of the transfer unit 70.

In the state in which the image forming units 22Y to 22K are housed in the image forming apparatus body 60, the rear end portions of the image forming units 22Y to 22K are positioned relative to the rear frame 66 of the image forming apparatus body 60, and the front end portions of the image forming units 22Y to 22K are positioned relative to the front plate 72 of the transfer unit 70 that is positioned relative to the image forming apparatus body 60. Thus, the image forming units 22Y to 22K housed in the image forming apparatus body 60 are positioned relative to the image forming apparatus body 60.

MODIFICATION

Figure 11:
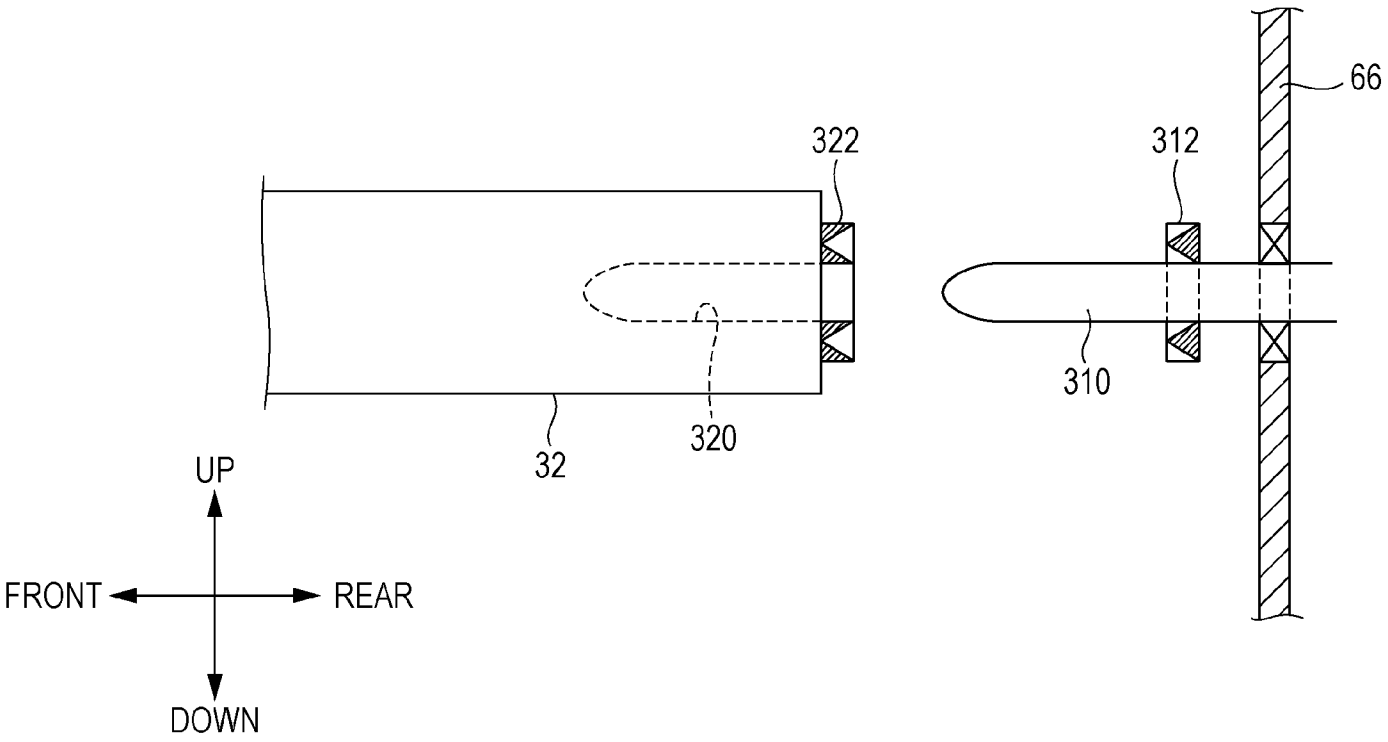
FIG. 11 is a side view illustrating a modification of a structure for positioning a rear end portion of the image forming unit relative to the image forming apparatus body.

While the rear end portions of the image forming units 22Y to 22K are positioned relative to the image forming apparatus body 60 by inserting the bearing portion 32B of each of the image forming units 22Y to 22K in the insertion hole 82 of the positioning member 80 in the exemplary embodiment, the present invention is not limited to this structures. For example, a structure illustrated in FIG. 11 may be adopted. In the structure illustrated in FIG. 11, a shaft portion 310 serving as an example of a projection is rotatably supported by the rear frame 66. The shaft portion 310 is rotated by driving force input from its rear end.

A front end of the shaft portion 310 has a tapered shape. A gear 312 is provided at a position in an axial intermediate portion of the shaft portion 310 and in front of the rear frame 66. Each photoconductor 32 has an insertion hole 320 into which the shaft portion 310 is to be inserted. At a rear end of the photoconductor 32, a gear 322 is provided to be engaged with the gear 312 in the front-rear direction. In this structure, the shaft portion 310 is inserted in the insertion hole 320 of the photoconductor 32 in the drawing direction, and the gear 312 and the gear 322 engage with each other in the drawing direction. Thus, the rear end portion of each of the image forming units 22Y to 22K is positioned relative to the rear frame 66 in the up-down direction and the right-left direction.

Figure 12:
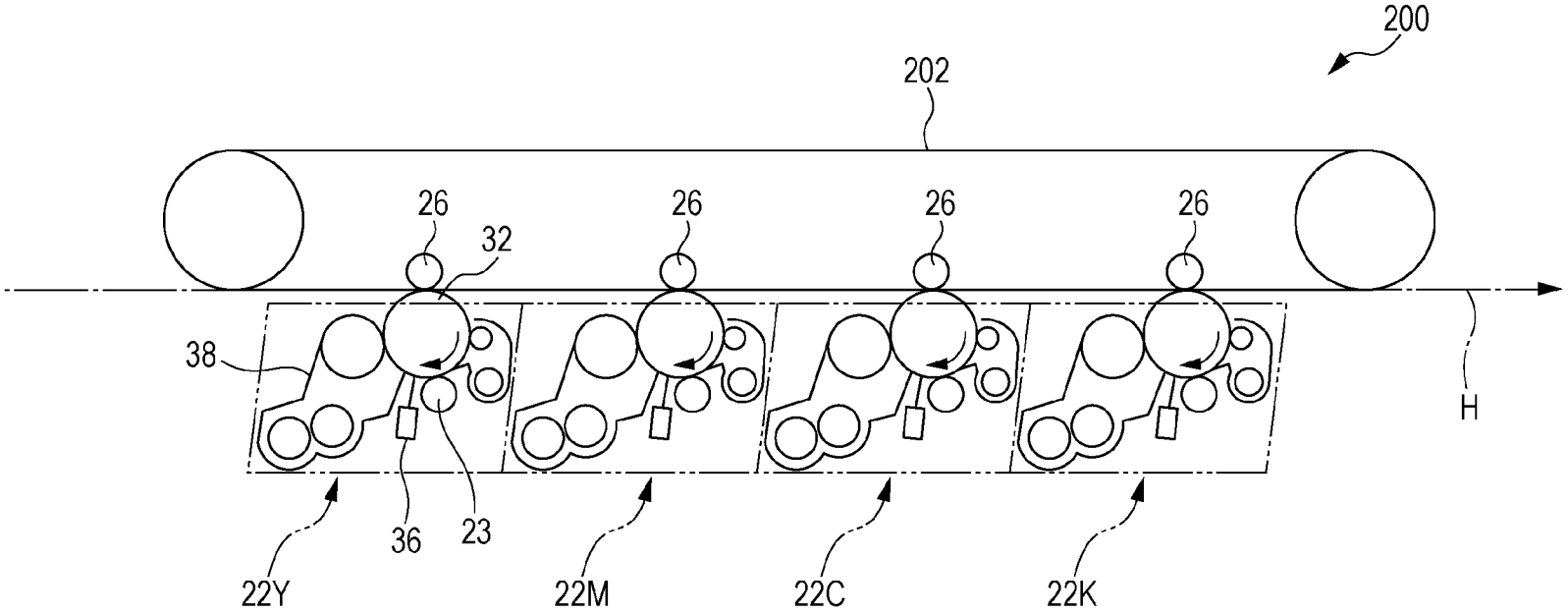
FIG. 12 is a schematic view illustrating the configuration of a direct-transfer image forming apparatus.

While the exemplary embodiment adopts the intermediate-transfer image forming apparatus 10 in which images transferred from the image forming units 22Y to 22K on the intermediate transfer belt 24 are transferred onto a recording medium P, the present invention is not limited thereto. As illustrated in FIG. 12, a direct-transfer image forming apparatus 200 may be adopted. The image forming apparatus 200 includes image forming units 22Y to 22K and a transport belt 202 serving as an example of a supported body.

In this structure, the transport belt 202 transports a recording medium P in a direction of arrow H, and color toner images formed by the image forming units 22Y to 22K are transferred onto the recording medium P. The transport belt 202 is configurated as a transport unit having a front plate 72 and a rear plate 74, similarly to the above-described transfer unit 70.

While the image forming body is formed by the plural image forming units 22Y to 22K in the exemplary embodiment, it may be formed by a single image forming unit.

While the front end portion of each of the image forming units 22Y to 22K is pulled toward the front plate 72 by the abutting member 100 in the exemplary embodiment, the present invention is not limited thereto. For example, the image forming units 22Y to 22K may be pressed against the front plate 72 of the transfer unit 70 by compression springs provided in a lower part of the front frame 64 (for example, a lower edge of the opening 64A).

While each of the image forming units 22Y to 22K is positioned by using the bearing portions 32A and 32B of the photoconductor 32 in the exemplary embodiment, the present invention is not limited thereto. For example, the image forming units 22Y to 22K may be positioned by using columnar or cylindrical projecting portions projecting from the front plate 29A and the rear plate 29B of the housing 29 of each of the image forming units 22Y to 22K.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiments was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a support body provided in an apparatus body configured to be removed from the apparatus body while supporting a supported body, and having a support portion on a front side of the support body in a drawing direction; and an image forming body on which an image to be transferred to the supported body or a recording medium transported by the supported body is formed, the image forming body being provided in the apparatus body and configured to be drawn out from the apparatus body in the drawing direction and being positioned relative to the apparatus body in an intersecting direction perpendicular to the drawing direction such that an end portion on a first side of the image forming body in the drawing direction abuts the support portion in the intersecting direction; and an abutting member extending from the image forming body to the support portion and configured to abut the first side with a force configured to pull the end portion toward the support portion, wherein the support body is configured to be positioned above the image forming body in the intersecting direction.

2. The image forming apparatus according to claim 1, wherein a projection provided in one of an end portion on a depth side of the image forming body in the drawing direction and the apparatus body is configured to be inserted in a hole provided in the other of the image forming body and the apparatus body such that the image forming body is positioned relative to the apparatus body in the intersecting direction.

3. The image forming apparatus according to claim 2, wherein the image forming body has a substantially circular bearing portion when viewed from the first side in the drawing direction, and wherein the support portion has a substantially V-shaped groove on which the bearing portion abuts at two points in response to the image forming body being disposed in the image forming apparatus.

4. The image forming apparatus according to claim 1, wherein the image forming body has a substantially circular bearing portion when viewed from the first side in the drawing direction, and wherein the support portion has a substantially V-shaped groove on which the bearing portion abuts at two points in response to the image forming body being disposed in the image forming apparatus.

* * * * *